US009593688B1

(12) United States Patent
Chandler

(10) Patent No.: US 9,593,688 B1
(45) Date of Patent: Mar. 14, 2017

(54) ELEVATED PLATFORM COOLING ASSEMBLY AND METHOD

(71) Applicant: Robert Chandler, Doyline, LA (US)

(72) Inventor: Robert Chandler, Doyline, LA (US)

( * ) Notice: Subject to any disclaimer, the term of this patent is extended or adjusted under 35 U.S.C. 154(b) by 30 days.

(21) Appl. No.: 14/196,359

(22) Filed: Mar. 4, 2014

(51) Int. Cl.
*F04B 23/00* (2006.01)
*F04D 25/02* (2006.01)

(52) U.S. Cl.
CPC ..... *F04D 25/02* (2013.01)

(58) Field of Classification Search
CPC ..... F04D 13/06; F04D 13/068; F04D 25/06; F04D 25/0673; F04D 25/08; F04D 29/263; F04D 29/325; F04D 25/02; F04D 25/04; F04D 25/045; F04D 29/644; F04D 29/646; F05B 2240/915; F05B 2240/9151
USPC ..... 417/231, 234, 390, 405; 416/63, 246, 416/244 R
See application file for complete search history.

(56) References Cited

U.S. PATENT DOCUMENTS 1,801,964 A * 4/1931 Kuendig ..... A47L 5/14 15/329
2,498,270 A * 2/1950 Hawley ..... E01F 9/0112 116/63 P
5,423,158 A * 6/1995 Vora ..... 52/745.17
5,845,886 A 12/1998 McCormick
6,227,488 B1 5/2001 Weiland
6,257,498 B1 * 7/2001 Siebol ..... A01M 7/0014 239/129
6,336,594 B1 * 1/2002 Bader ..... F04D 29/601 169/48
6,550,725 B1 4/2003 Watson
6,588,372 B1 7/2003 Terrell et al.
6,705,599 B2 3/2004 Terrell et al.
6,789,787 B2 9/2004 Stutts
7,574,832 B1 * 8/2009 Lieberman ..... 52/118
7,891,210 B2 2/2011 Dubensky et al.
8,439,534 B1 5/2013 Roe et al.
2008/0266859 A1 * 10/2008 Palmisano ..... F21V 17/007 362/249.07
2009/0166444 A1 * 7/2009 Peterson ..... 239/13
2012/0042536 A1 * 2/2012 White ..... 34/486
2013/0026333 A1 1/2013 Wu
(Continued)

FOREIGN PATENT DOCUMENTS

DE 2735970 * 3/1979 ..... F26B 21/024
EP 0 908 215 * 8/1998

OTHER PUBLICATIONS

DE2735970 translation, Max Wagner, Drying room air circulation system—has air forced down vertical tube to operate pneumatic motors driving fans, Mar. 8, 1979.*

*Primary Examiner* — Charles Freay
(74) *Attorney, Agent, or Firm* — R. Keith Harrison

(57) ABSTRACT

An elevated platform cooling assembly includes a portable assembly frame; a mast carried by the assembly frame, the mast selectively positional between a folded, collapsed transport configuration and an erected, extended functional and operational configuration; a fan carried by the mast; a fan motor drivingly engaging the fan; a working fluid pump and supply mechanism disposed in fluid communication with the fan motor; and 4 prime mover drivingly engaging the working fluid pump and supply mechanism. A method of cooling an elevated platform is also disclosed.

4 Claims, 10 Drawing Sheets

(56) References Cited

U.S. PATENT DOCUMENTS

2015/0114717 A1* 4/2015 Fortson ..... E21B 15/003
175/57

* cited by examiner

ELEVATED PLATFORM COOLING ASSEMBLY AND METHOD

CROSS-REFERENCE TO RELATED APPLICATIONS

This is a continuation-in-part of U.S. application Ser. No. 13/919,298, filed Jun. 17, 2013 and entitled ELEVATED PLATFORM COOLING ASSEMBLY AND METHOD, which application is incorporated by reference herein in its entirety.

FIELD

Illustrative embodiments of the disclosure generally relate to elevated platforms such as mobile rig platforms winch support personnel and/or equipment in drilling, remediation and/or other downhole operations in subterranean hydrocarbon wells. More particularly, illustrative embodiments of disclosure relate to an elevated platform cooling assembly and method which are suitable for cooling personnel and/or equipment on an elevated platform such as a mobile drilling or workover rig platform.

BACKGROUND

The background description provided, herein is solely for the purpose of generally presenting the context of the illustrative embodiment of the disclosure. Aspects of the background description are neither expressly nor impliedly admitted as prior art against the claimed subject matter.

Mobile drilling rigs and workover rigs are elevated structures which effect drilling, remediation and/or other downhole operations in a well bore of a subterranean hydrocarbon well. Drilling and workover rigs typically include an elevated rig platform which is placed over the well bore and a derrick which extends from the rig platform. The derrick may support the assembly and use of a tubing string and tools that extend into the well bore to effect the downhole operations.

Personnel typically stand on the rig platform to direct assembly and use of the tubing string and manipulation of the tools in the downhole operations. As these operations are frequently labor-intensive, it is often necessary for the personnel to take frequent breaks in mobile off-platform air-conditioned trailers to avoid overheating, particularly during hot weather. This requirement may interrupt operations, resulting in profit loss as well as increased costs incurred in transporting the trailers among multiple well sites to periodically cool the personnel.

Accordingly, an elevated platform cooling assembly and method which are suitable for cooling personnel and/or equipment on an elevated platform such as a mobile drilling or workover rig platform may be desirable for some applications.

SUMMARY

Illustrative embodiments of the disclosure are generally directed to an elevated platform cooling assembly suitable for cooling personnel and/or equipment on an elevated platform such as a mobile drilling or workover rig platform. An illustrative embodiment of the assembly includes a portable assembly frame; a mast carried by the assembly frame, the mast selectively positional between a folded, collapsed transport configuration and an erected, extended, functional and operational configuration; a fan carried by the mast; a fan motor drivingly engaging the fan; a working fluid pump and supply mechanism disposed in fluid communication with the fan motor; and a prime mover drivingly engaging the working fluid pump and supply mechanism.

Illustrative embodiments of the disclosure are further generally directed to an elevated platform cooling method which is suitable for cooling personnel and/or equipment on an elevated platform such as a mobile drilling or workover rig platform. An illustrative embodiment of the method includes providing an elevated platform cooling assembly having a portable assembly frame, a mast selectively positional between a folded and collapsed transport configuration and an erected and extended functional configuration on the assembly frame, a fan on the mast, a fan motor drivingly engaging the fan, a working fluid pump and supply mechanism disposed in fluid communication with the fan motor and a prime mover drivingly engaging the working fluid pump and supply mechanism; deploying the mast in the transport configuration on the assembly frame;transporting the elevated platform cooling assembly to the elevated platform; positioning the elevated platform cooling assembly adjacent to the elevated platform; raising the fan to a level of the elevated platform by erecting and extending the mast from the transport configuration to the functional configuration on the assembly frame; and forcing a stream of air from the fan across the elevated platform by operation of the working fluid pump and supply mechanism.

BRIEF DESCRIPTION OF THE DRAWINGS

Illustrative embodiments of the disclosure will now be described, by way of example, with reference to the accompanying drawings, in which.

DETAILED DESCRIPTION

Figure 3:
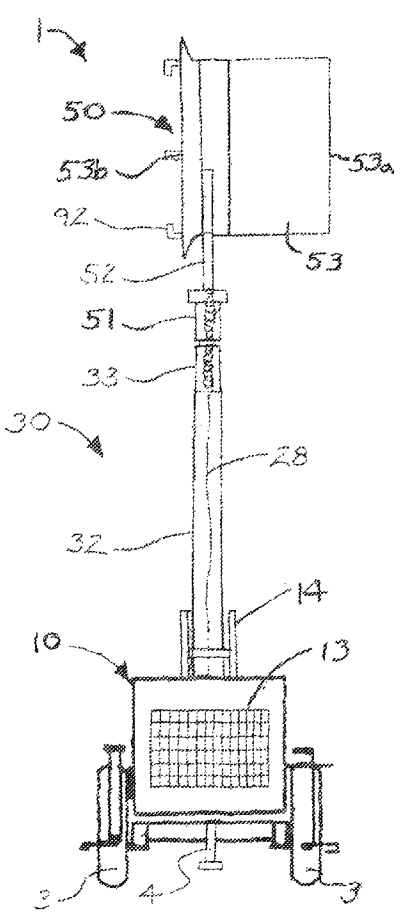
FIG. 3 is a rear view of an illustrative elevated platform cooling assembly, with the mast deployed in the erected and telescopically collapsed configuration.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description. As used herein, relative terms such as "bottom", "middle" and "top" are used to describe exemplary positions of various components relative to each other in exemplary use of the elevated platform cooling assembly and are not intended to be construed in a limiting sense.

Referring initially to FIGS. 1-11 of the drawings, an illustrative embodiment of the elevated platform cooling assembly, hereinafter assembly, is generally indicated by reference numeral 1. The assembly 1 may include a portable assembly frame 2 having wheels 3. Outriggers 4 may be selectively extendable from the assembly frame 2 for stabilizing purposes. A hitch coupling 5 may extend forwardly from the assembly frame 2 for coupling with a towing vehicle (not illustrated) typically in the conventional manner for transport of the assembly 1.

Figure 8:
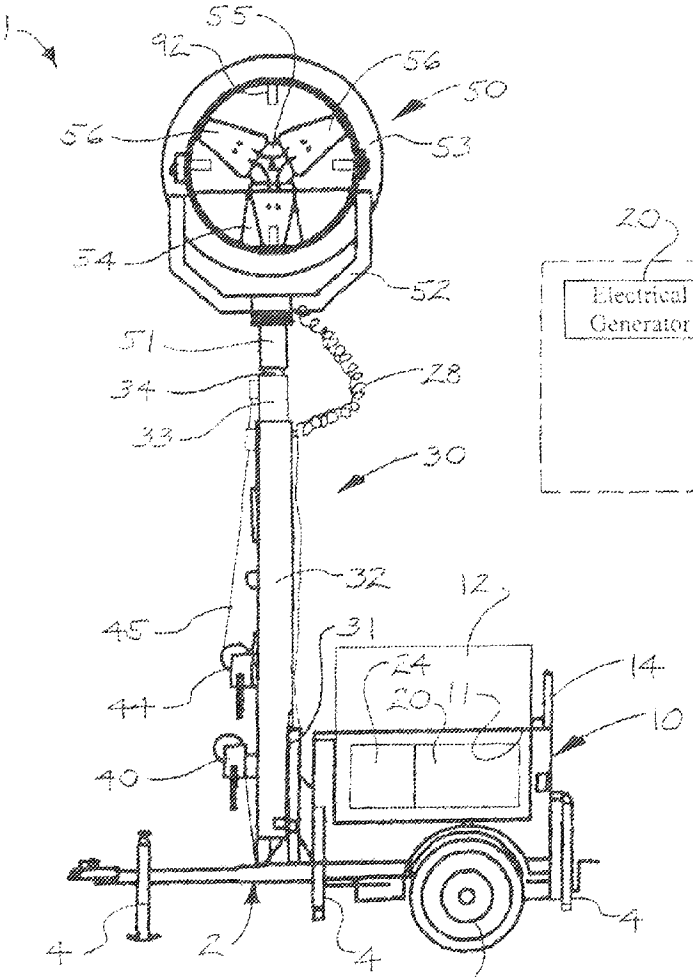
FIG. 8 is a side view of an illustrative elevated platform cooling assembly, with a housing door on a pump housing deployed in an open position to expose a working fluid pump and supply mechanism and a regulated control assembly in the pump housing.

A generator housing 10 may be supported by the assembly frame 2. As illustrated in FIG. 8, the generator housing 10 may have a housing opening 11 which is selectively closed by a housing door 12. An air inlet grill 13 (FIG. 3) may be provided in the generator housing 10. A mast support bracket 14 may extend from the generator housing 10 for purposes which will be hereinafter described.

Figure 9:
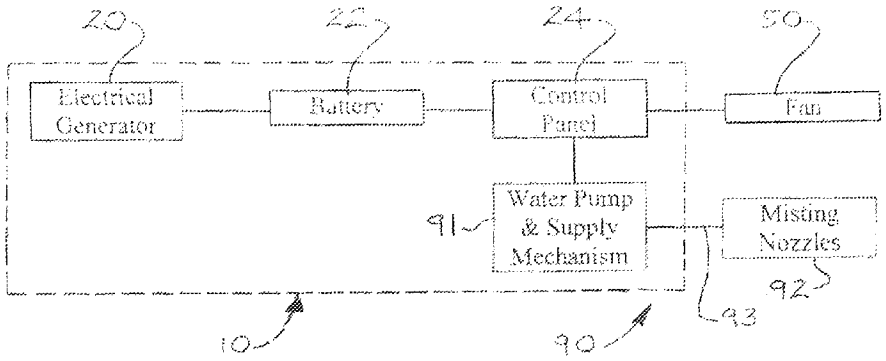
FIG. 9 is a functional block diagram illustrating exemplary functional components of an illustrative embodiment of the elevated platform cooling assembly.

As further illustrated in FIG. 8. in some embodiments, a source of electrical power which may include an electrical generator 20, for example and without limitation, may be provided in the generator housing 10. As illustrated in FIG. 9, at least one battery 22 may electrically interface with the electrical generator 20. A control panel 24 may interface with the battery 22. Additional components such as an inverter, for example, may be provided between the battery 22 and the control panel 24. In some embodiments, the battery 22 may be omitted and the electrical generator 20 may interface directly with the control panel 24. A fan 50 has a fan motor 54 (FIG. 1) which electrically interfaces with the control panel 24 such as through a wiring cable 28. The control panel 24 may include features (not illustrated) which are adapted to actuate the electrical generator 20 and the operation and speed of the fan 50 responsive to user input, as will be hereinafter described. In other embodiments, the fan 50 may be adapted for electrical connection to any suitable Source of electrical power which may include an electrical generator 20 and/or at least one battery 22, either or both of which may or may not be supported by the assembly frame 2, and/or a fixed electrical outlet (not illustrated).

A mast 30 is supported by the assembly frame 2. The fan 50 is supported by the mast 30. The mast 30 is selectively positional between a folded, telescopically collapsed and non-functional transport configuration illustrated in FIG. 4 and an erected, telescopically extended and functional operational configuration illustrated in FIG. 7. The mast 30 may include a mast base 31 which is upward-standing from the assembly frame 2. A bottom mast arm 32 may be pivotally attached to the mast base 31. At least one mast arm 33, 34 may be selectively telescopically extendable from the bottom mast arm 32. In some embodiments, a middle mast arm 33 may be selectively telescopically extendable from the bottom mast arm 32 and top mast arm 34 may be selectively telescopically extendable from the middle mast arm 33. The fan 30 may be supported in the top mast arm 34 such as in a manner which will be hereinafter described. In some embodiments, additional mast arms (not illustrated) may be selectively telescopically extendable from the top mast arm 34 to achieve a selected height of the mast 30 when the mast 30 is deployed in the erected configuration of FIG. 7. In some embodiments, the height of the mast 30, including the fan 50 which is supported by the top mast arm 34, may be at least about 30 feet. In other embodiments, the erected mast 30 may be longer or shorter depending on the particular application of the assembly 1.

Figure 4:
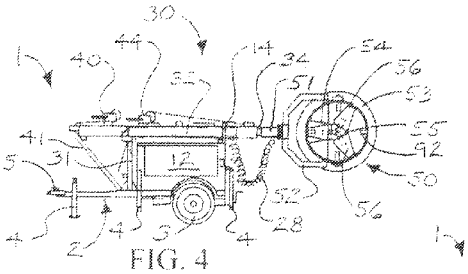
FIG. 4 is a side view of an illustrative elevated platform cooling assembly, with the mast deployed in a folded and telescopically collapsed transport configuration.
Figure 6:
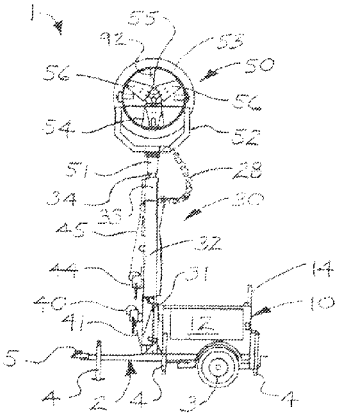
FIG. 6 is a side view of an illustrative elevated platform cooling assembly, with the mast deployed in the erected and telescopically collapsed configuration.
Figure 7:
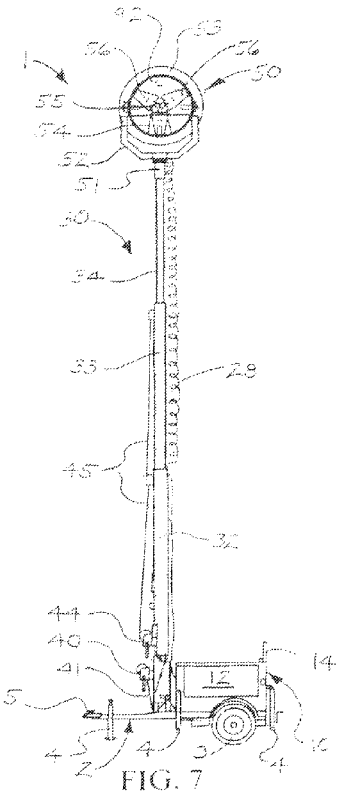
FIG. 7 is a side view of an illustrative elevated platform cooling assembly, with the mast deployed in an erected and fully-extended, functional or operational configuration.

The mast 30 may be selectively deployed between the folded configuration illustrated in FIG. 4, in which the mast 30 rests horizontally on the mast support bracket 14, and the vertical erected configuration illustrated in FIGS. 6 and 7 according to any technique which is suitable for the purpose, in some embodiments, a mast erection winch 40, which may be manual or electric, may be provided on the bottom mast arm 32. An erection winch cable 41 may be wound on the mast erection winch 40 and attached to the assembly frame 2 or the mast base 31. Accordingly, the mast 30 can be selectively deployed between the folded configuration and the erected configuration responsive to operation of the mast erection winch 40.

Figure 5:
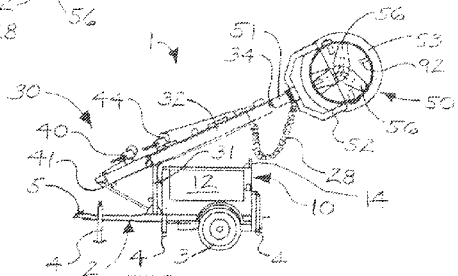
FIG. 5 is a side view of an illustrative elevated platform cooling assembly, with the mast deployed in a partially-erected and telescopically collapsed configuration.

The mast 30 may be selectively deployed between the telescopically collapsed configuration illustrated in FIGS. 4-6 and the telescopically extended configuration illustrated in FIG. 7 according to any technique which is known by those skilled in the art and suitable for the purpose. In some embodiments, a mast extension winch 44, which may be manual or electric, may be provided on the bottom mast arm 32. An extension winch cable 45 may be wound on the mast extension winch 44 and attached to the middle mast arm 33 and the top mast arm 34. The mast 30 can be selectively deployed between the telescopically collapsed and telescopically extended configurations responsive to operation of the mast extension winch 44.

Figure 2:
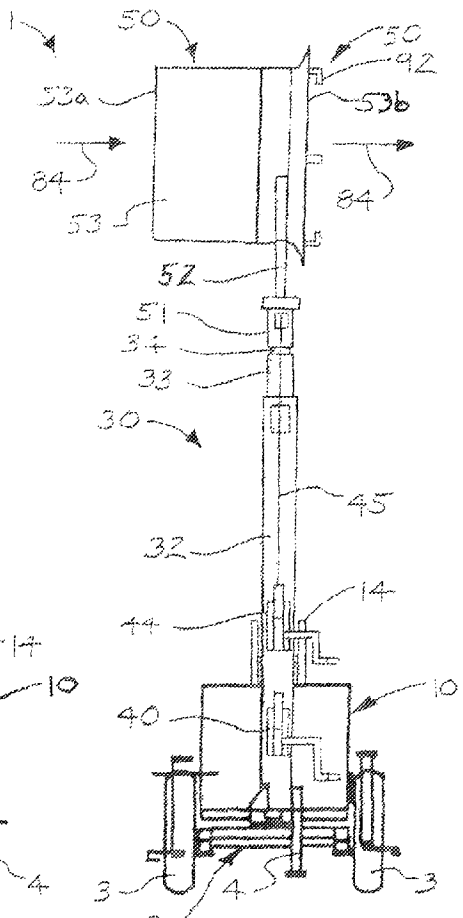
FIG. 2 is a front view of an illustrative elevated platform cooling assembly, with the mast deployed in the erected and telescopically collapsed configuration.
Figure 1:
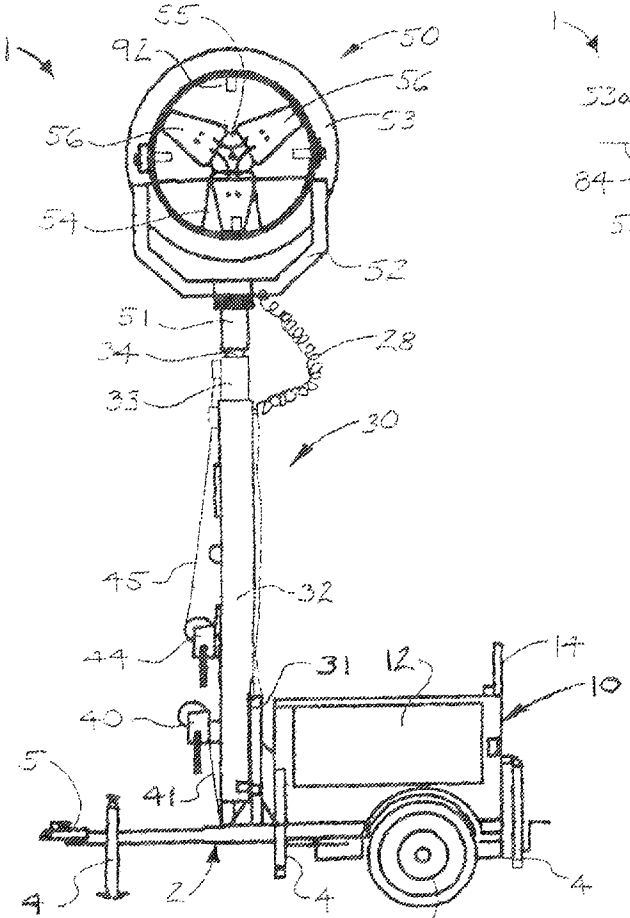
FIG. 1 is a side view of an illustrative embodiment of the elevated platform cooling assembly, with a mast component of the assembly deployed in an erected and telescopically collapsed configuration.

The fan 50 may be mounted on the top mast arm 34 of the mast 30 according to any suitable attachment technique which is known by those skilled in the art and suitable for the purpose. In some embodiments, a fan mount collar 51 may receive the upper end of the top mast arm 34. A fan mount bracket 52 may be fixedly or rotatably attached to the fan mount collar 51 according to the knowledge of those skilled in the art. A fan housing 53 having an air inlet side 53*a* and an air outlet side 53*b* (FIG. 2) may be mounted on the fan mount bracket 52. A fan motor 54 (FIG. 1) may be mounted in the fan housing 53. A fan hub 55 is drivingly engaged for rotation by the fan motor 54. Multiple fan blades 56 extend outwardly from the fan hub 55. A flexible wiring cable 28 may electrically connect the control panel 24 (FIG. 9) to the fan motor 54 of the fan 50 to facilitate flow of electrical current to the fan motor 54 and selective operation of the fan 50 by user manipulation of the control panel 24. Accordingly, as illustrated in FIG. 2, by operation of the fan 50, air 84 is drawn through the fan housing 53 from the air inlet side 53*a* and forced from the air outlet side 53*b* typically in the conventional manner. In some embodiments, the fan 50 may be a commercially-available high-velocity fan having fan blades 56 of at least about 24~30 inches or more in diameter.

As illustrated in FIG. 9, in some embodiments, the assembly 1 may include a misting system 90. The misting system 90 may include a water pump and supply mechanism 91 which is adapted to contain a supply of water or other cooling liquid (not illustrated) and functionally interfaces with the control panel 24. At least one misting nozzle 92 may be disposed in fluid communication with the water pump and supply mechanism 91 through a conduit 93. The misting nozzle 92 may be provided on the fan housing 53 at the air outlet side 53*b*. Accordingly, in operation of the assembly 1, which will be hereinafter described, the water pump and supply mechanism 91 can be selectively operated to pump water through the conduit 93 and the misting nozzles 92 discharge the water into the path of air 84 which flows from the air outlet side 53*b* of the fan housing 53, forming mist 94 in the air 84, as illustrated in FIG. 12.

Figures 10, 11:
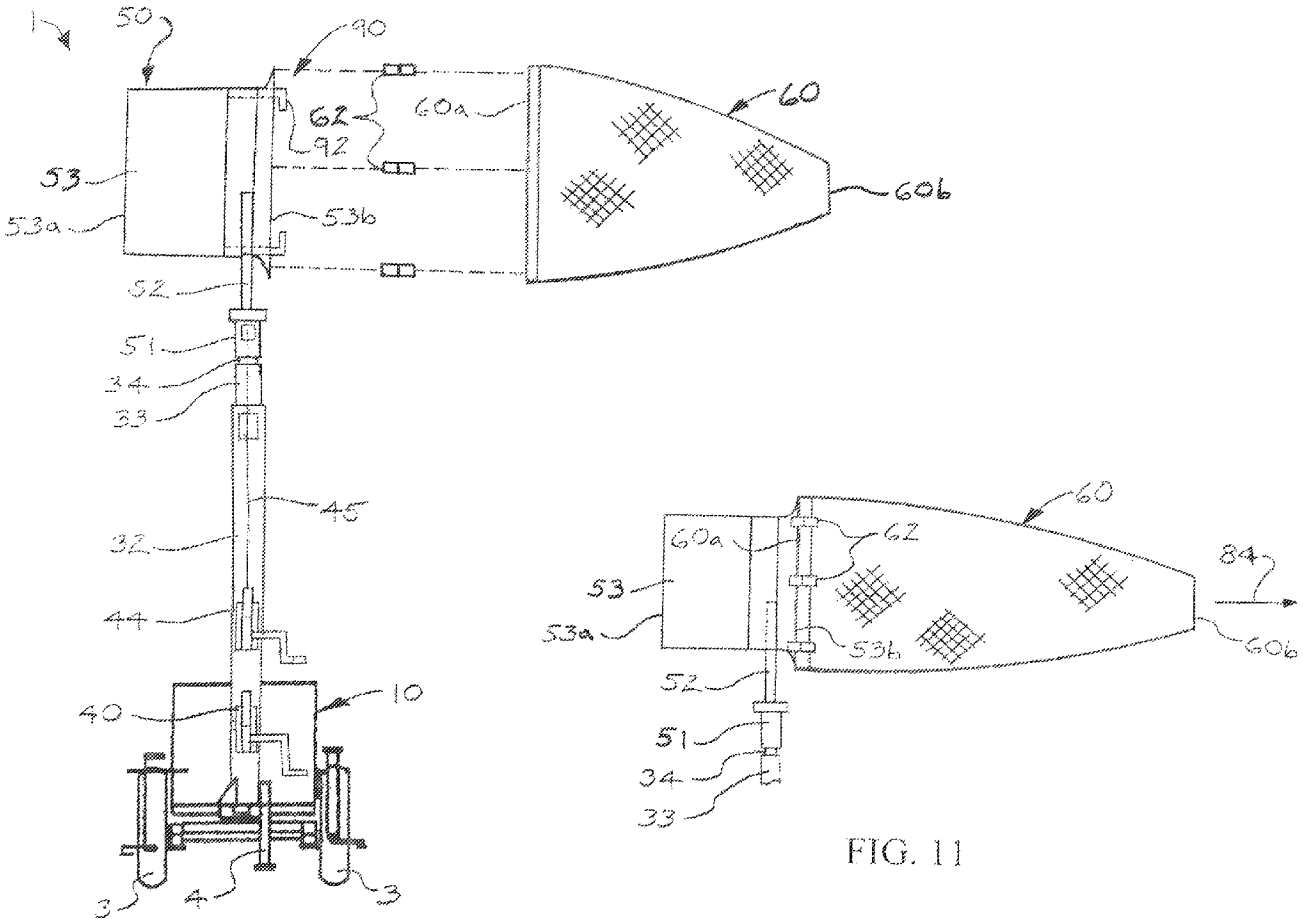
FIG. 10 is an exploded front view of an illustrative elevated platform cooling assembly, more particularly illustrating exemplary attachment of an air sock to a fan of the assembly in exemplary application of the assembly.
FIG. 11 is a side view, partially in section, of the fan of the elevated platform cooling assembly, with the air sock attached to the fan.

As illustrated in FIGS. 10 and 11 of the drawings, in some embodiments, an air sock 60 may be attached to the fan housing 53 of the fan 50. The air sock 60 may include fabric and/or other flexible and/or semi-flexible material. In some embodiments, the air sock 60 may be generally elongated and conical, gradually tapering from an air inlet end 60*a* to an air outlet end 60*b*. In other embodiments, the air sock 60 may be non-tapered from the air inlet end 60*a* to the air outlet end 60*b*. The air inlet end 60*a* of the air sock 60 may be attached to the air outlet side 53*b* of the fan housing 53 such as by using clamps 62 and/or any other suitable attachment technique which is known by those skilled in the art. Accordingly, in operation of the fan 50, air 84 (FIG. 11) flows from the air outlet side 53*b* of the fan housing 53 through the air sock 60 and is discharged front the air outlet end 60*b*. The flowing stream of air 84 maintains the horizontal and erect configuration of the air sock 60, which concentrates the stream of air 84 as it is discharged from the air outlet end 60*b*. The air sock 60 renders the concentrated stream of air 84 and the mist 94 directionally controllable for purposes which will be hereinafter described.

Figure 12:
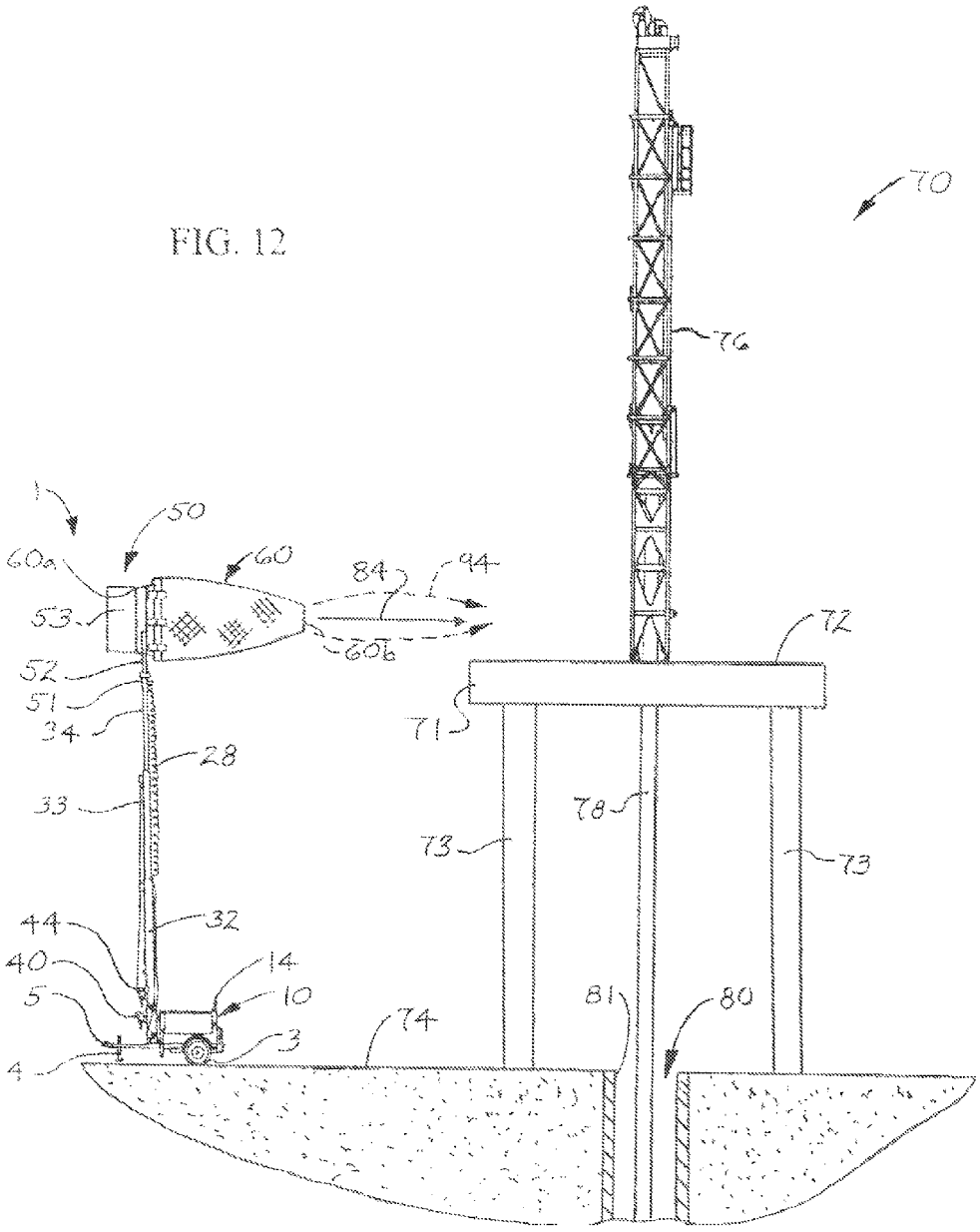
FIG. 12 is a side view of a workover or drilling rig, more particularly illustrating exemplary application of a stream of cooling air across a platform floor of the rig according to an illustrative elevated platform cooling method.

Referring next to FIG. 12 of the drawings, exemplary application of the apparatus 1 according to an illustrative elevated platform cooling method is illustrated. A workover/drilling rig 70 may include a rig platform 71 which is elevated over the ground 74 on multiple support pylons 73. The rig platform 71 has a platform floor 72. A subterranean hydrocarbon well bore 80, typically lined by a well casing 81, extends into the ground 74 beneath the rig platform 71. A derrick 76 extends upwardly from the platform floor 72. In some applications, the derrick 76 may support a rotary table (not illustrated) which is used to assemble a tubing string 78 that extends through a tubing opening (not illustrated) in the rig platform 71 into the well casing 81 of the underlying hydrocarbon well bore 80, typically in the conventional manner. The tubing string 78 may be used in various drilling, remediation and/or other operations within the hydrocarbon well bore 80 as is well known by those skilled in the art.

The elevated platform cooling assembly 1 may be towed to the site of the rig 70 by coupling the hitch coupling 5 on the assembly frame 2 to a hitch (not illustrated) on a towing vehicle (not illustrated). Preparatory to towing, the mast 30 may be deployed in the folded and telescopically collapsed configuration illustrated in FIG. 4 with the bottom mast arm 32 of the mast 30 deployed in a generally horizontal position and supported by the mast support bracket 14 on the generator housing 10 of the assembly 1.

After arrival at the rig site, the elevated platform cooling assembly 1 is deployed generally adjacent to the rig 70. The air sock 60 may be attached to the fan 50 typically as was heretofore described with respect to FIGS. 10 and 11. The mast 30 is deployed from the folded and telescopically collapsed transport configuration illustrated in FIG. 4 to the erected and telescopically extended functional configuration illustrated in FIGS. 7 and 12, typically by operation of the mast erection winch 40 and the mast extension winch 44, respectively. The length of the mast 30 may be selected such that the height of the an 50 and the air such 60 are positioned at generally above the height of the platform floor 72 of the rig platform 71, with the air sock 60 oriented towards the platform floor 72.

Throughout operation of the rig 70, personnel (not illustrated) typically stand on the platform floor 72 of the rig platform 71 to direct assembly of the tubing string 78 as well as the drilling and/or well remediation operations. These operations may require physical labor on the part of the personnel as the personnel stand on the platform floor 72. Accordingly, the fan 50 of the assembly 1 is operated typically via user input at control panel 24 (FIGS. 8 and 9) to force a continuous stream of air 84 towards and then across the surface of the platform floor 72. The misting system 90 may be operated to dispense mist 94 from the misting nozzles 92 (FIG. 10) into the flowing air 84. Therefore, the personnel standing on the platform floor 72 are continuously cooled by the flowing air 84 and the mist 94 and can continuously carry out the drilling, remediation and/or other operations within the hydrocarbon well bore 80 for longer periods than would otherwise be feasible, particularly in hot weather. It will be appreciated by those skilled in the art that the air sock 60 concentrates and directs the stream of air 84 as it flows across the platform floor 72. This expedient permits placement of the assembly 1 at a sufficient distance from the rig 70 to prevent the assembly 1 from interfering with movement of the personnel and equipment on the platform floor 72 of the rig platform 71 as the operations are carried out.

Figure 13:
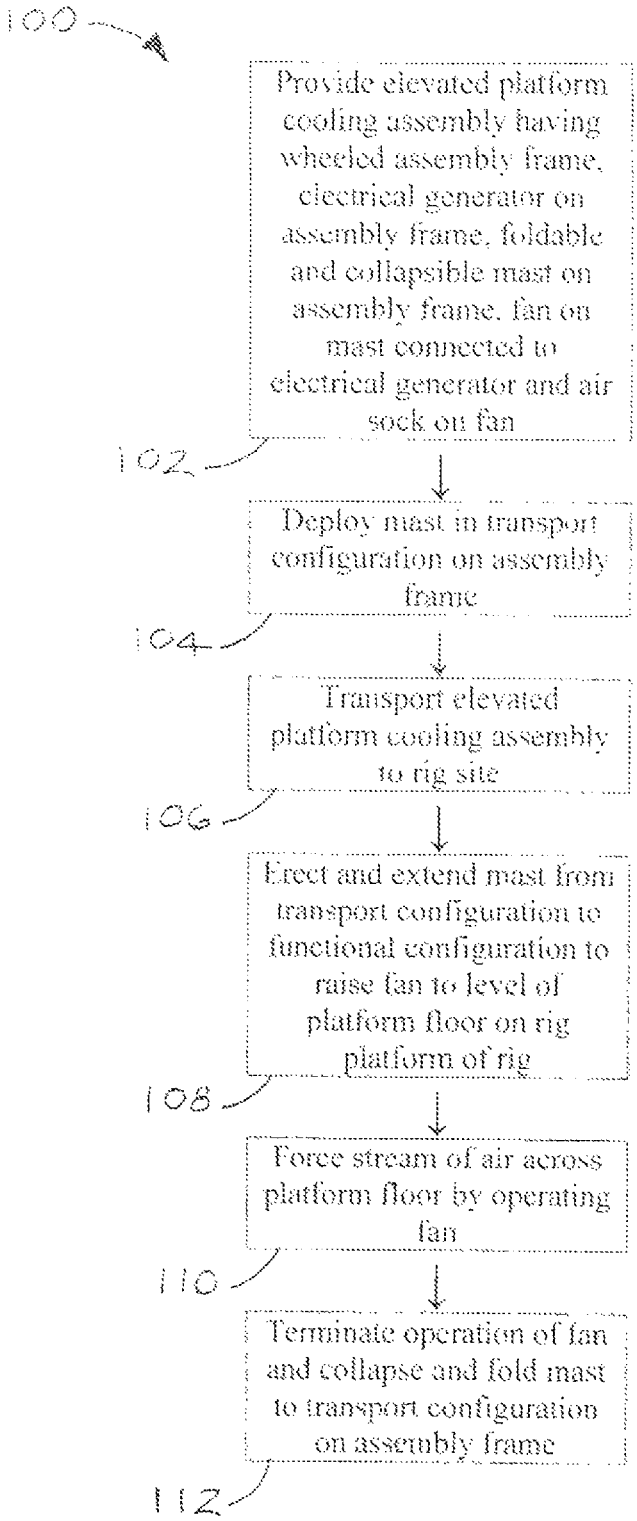
FIG. 13 is a flow diagram of an illustrative elevated platform cooling method.

Referring next to FIG. 13 of the drawings, a flow diagram 100 of an illustrative elevated platform cooling method is illustrated. In block 102, an elevated platform cooling assembly is provided. The elevated platform cooling assembly may include a wheeled assembly frame, an electrical generator and/or other source of electrical power which may be supported by the assembly frame, a selectively foldable and collapsible mast on the assembly frame and a fan on the mast and connected to the electrical generator. In some applications, an air sock may be attached to the fan. In block 104, the mast may be deployed in a folded and telescopically collapsed transport configuration on the assembly frame. In block 106, the elevated platform cooling assembly may be transported to a rig site such as by towing the assembly behind a toning vehicle, for example and without limitation. In block 108, the mast may be erected and extended from the transport configuration to an erected and telescopically extended functional or operational configuration to raise the fan to the level of a platform floor on the rig platform of the rig. In block 110, a stream of air may be forced across the platform floor by operating the fan. In some applications, the scream of air may be concentrated and directed across the platform floor such as by using the air sock. In some applications, mist may be dispensed into the stream of air. In block 112, operation of the fan may be terminated and the mast may be folded and telescopically collapsed back to the transport configuration on the assembly frame.

Figure 14:
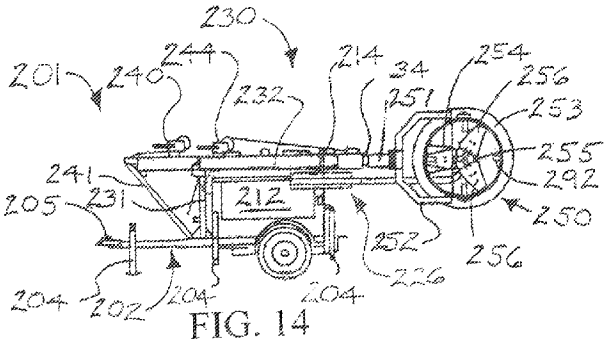
FIG. 14 is a side view of an alternative illustrative embodiment of the elevated platform cooling assembly, with the mast deployed in a folded and telescopically collapsed transport configuration.
Figure 17:
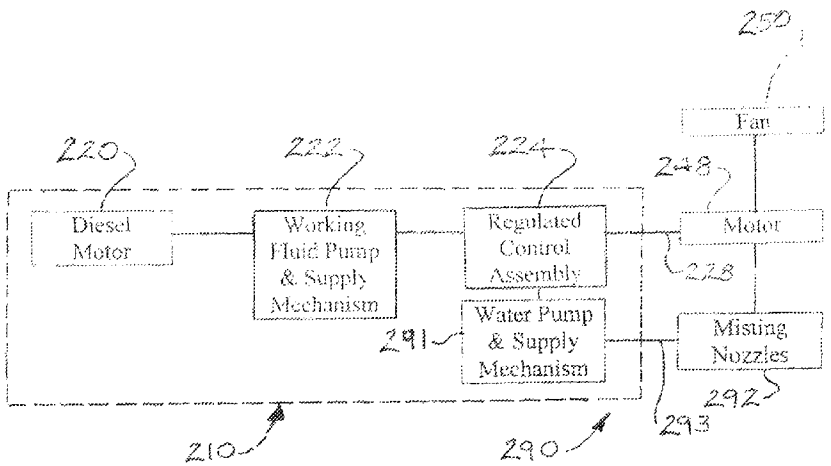
FIG. 17 is a functional block diagram illustrating exemplary functional components of the illustrative elevated platform cooling assembly illustrated in FIG. 14.

Referring next to FIG. 14 of the drawings, an alternative illustrative embodiment of the elevated platform cooling assembly, hereinafter assembly, is generally indicated by reference numeral 201. In the assembly 201, elements which are analogous to the respective elements of the assembly 1 that was heretofore described with respect to FIGS. 1-12 are designated by the same numeral in the 201-299 series in FIGS. 14-18. The assembly 201 may include a pump housing 210 which is supported on the assembly frame 202. As illustrated in FIG. 17, a prime mover such as a diesel motor 220, for example and without limitation, may be provided in the pump housing 210. A working fluid pump and assembly mechanism 222 in the pump housing 210 may be drivingly engaged by the diesel motor 220. A regulated control assembly 224 may be disposed in fluid communication with the working fluid pump and supply mechanism 222 and the water pump arid supply mechanism 291. A hydraulic or pneumatic fan motor 248 may be disposed in fluid communication with the regulated control assembly 224 through fluid hoses 228. The fluid hoses 228 may include an output fluid hose (not illustrated) which facilitates flow of working fluid from the working fluid pump and assembly mechanism 222 to the fan motor 248 and a return or input fluid hose (not illustrated) which facilitates flow of working fluid from the fan motor 248 to the working fluid pump and assembly mechanism 222. The fan motor 248 drivingly engages the fan 250 and may be mounted on the fan mount collar 251 (FIG. 16) of the mast 230. The regulated control assembly 224 may be electrically connected to the diesel motor 220 for selective control of the diesel motor 220 according to the knowledge of those skilled in the art. The regulated control assembly 224 may include a pressure regulating valve (not illustrated) through which working fluid flows to control the operational speed of the fan motor 248.

Figure 15:
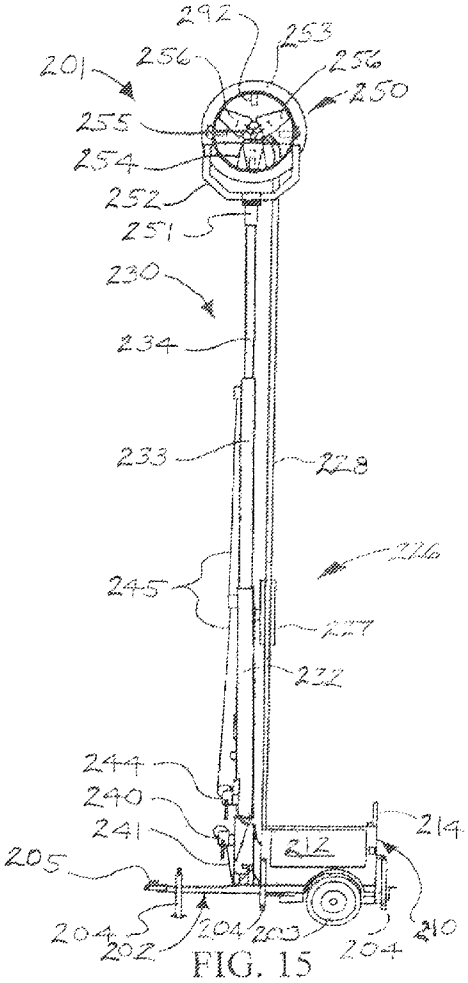
FIG. 15 is a side view of the illustrative elevated platform cooling assembly illustrated in FIG. 14, with the mast deployed in an erected and fully-extended, functional or operational configuration.
Figure 16:
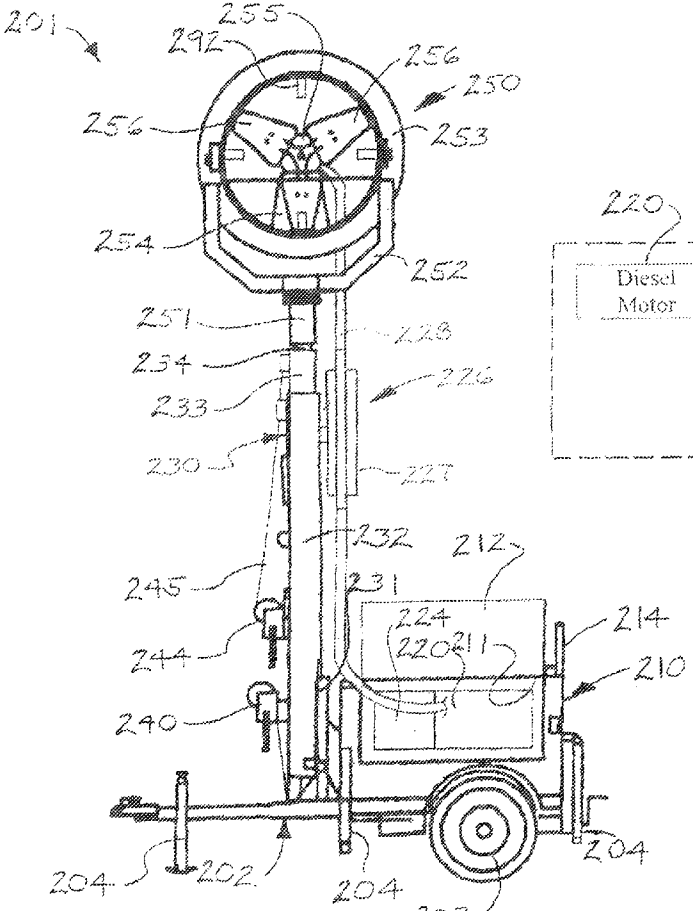
FIG. 16 is a side view of the illustrative elevated platform cooling assembly illustrated in FIG. 14, with a housing door on a pump housing deployed in an open position to expose a working fluid pump and supply mechanism and a regulated control assembly in the pump housing.
Figure 18:
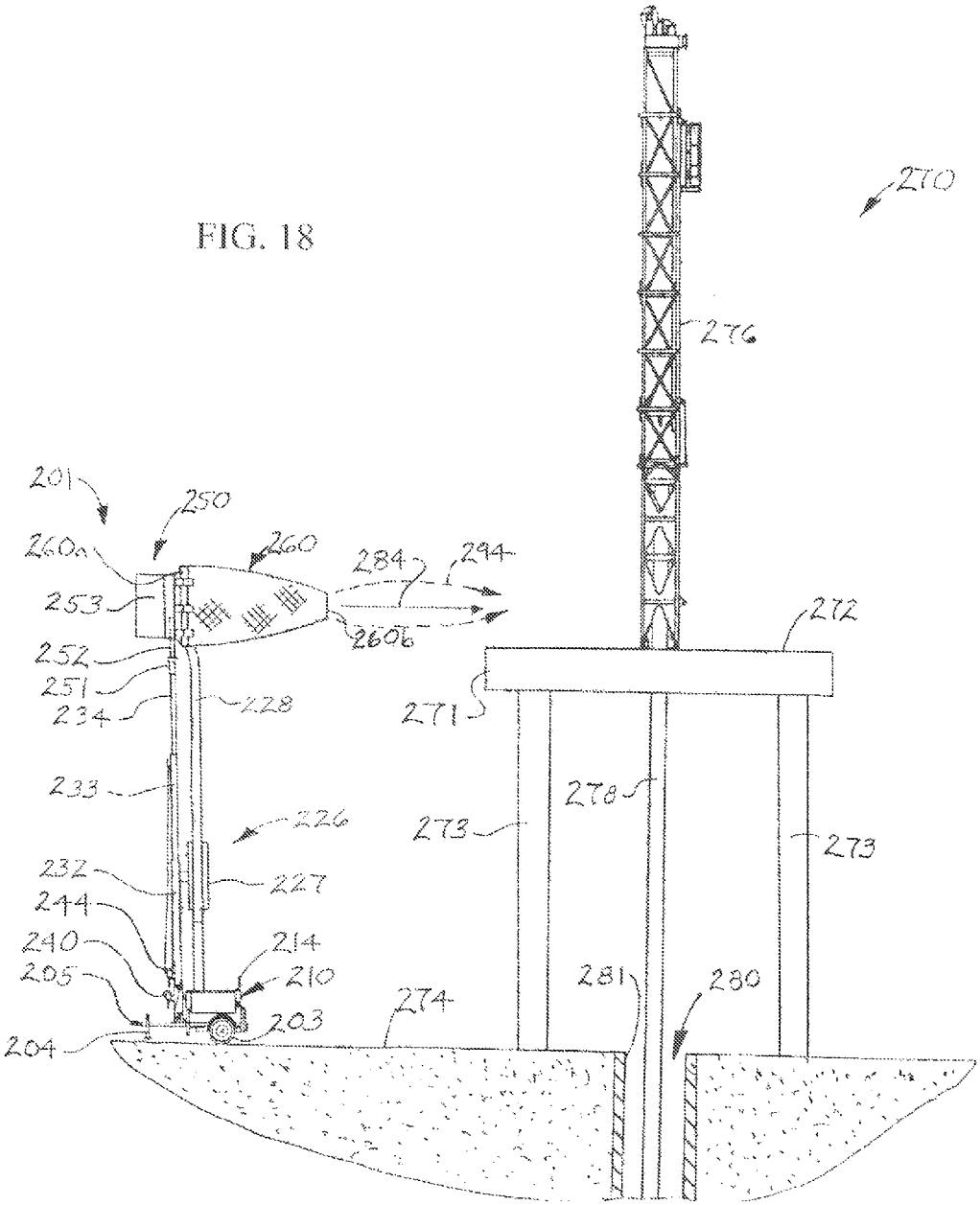
FIG. 18 is a side view of a workover or drilling rig, more particularly illustrating exemplary application of a stream of cooling air across as platform floor of the rig according to an illustrative elevated platform cooling method.
Figure 19:
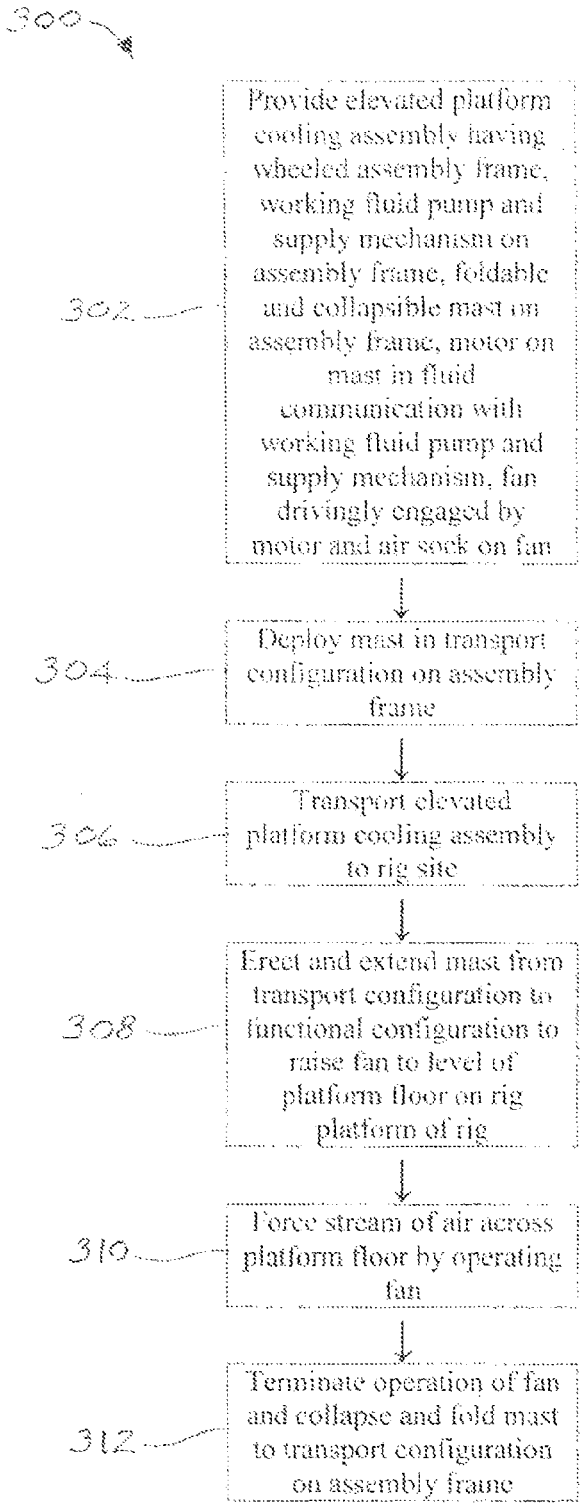
FIG. 19 is a flow diagram of an alternative illustrative elevated platform cooling method.

As illustrated in FIGS. 14-16, a hose assembly 225 may be provided on the mast 230 to facilitate lengthening and shortening of the fluid hoses 228 as the mast 230 is deployed between the stowed configuration of FIG. 14 and the deployed configuration of FIG. 18. The hose assembly 226 may include a hose reel 227 which is mounted on the bottom mast arm 232 of the mast 230. The fluid hoses 228 may be wound on the hose reel 227 as the fluid hoses 228 traverse from the regulated control assembly 224 in the pump housing 210 to the fan motor 248 typically mounted on the fan mount collar 251.

The working fluid pump and supply mechanism 222 may be adapted to contain a supply of working fluid (not illustrated). In some embodiments, the working fluid pump and supply mechanism 222 may include a hydraulic fluid pump and supply mechanism which contains a supply of hydraulic fluid. In some embodiments, the working fluid pump and supply mechanism 222 may include a pneumatic pump and supply mechanism which compresses and contains compressed air. Responsive to operation of the diesel motor 220, the working fluid (hydraulic fluid or air) is compressed in the working fluid pump and supply mechanism 222. The regulated control assembly 224 may be operated to facilitate flow of the pressurized working fluid from the working fluid pump and supply mechanism 222 through the fluid hoses 228 to the fan motor 248, which rotates the fan 250. The fluid hoses 228 may return the working fluid from the fan motor 248 to the working fluid pump and supply mechanism 222 in a continuous hydraulic or pneumatic circuit according to the knowledge of those skilled in the art.

Exemplary application of the apparatus 201 according to an illustrative elevated platform cooling method is illustrated may be as was heretofore described with respect to application of the apparatus 101 in FIG. 12. Accordingly, after arrival at the rig site, the elevated platform cooling assembly 201 is deployed generally adjacent to the rig 270. In some applications, an air sock 260 may be attached to the fan 250 typically as was heretofore described with respect to the assembly 1 in FIGS. 10 and 11. The mast 230 is deployed from the folded and telescopically collapsed transport configuration illustrated in FIG. 14 to the erected and telescopically extended functional configuration illustrated in FIGS. 15 and 18, typically by operation of the mast erection winch 240 and the mast extension winch 244, respectively. The length of the mast 230 may be selected such that the height of the fan 250 and the air sock 260 are positioned at generally above the height of the platform floor 272 of the rig platform 271, with the air sock 260 oriented towards the platform floor 272.

Throughout operation of the rig 270, personnel (not illustrated) typically stand on the platform floor 272 of the rig platform 271 to direct assembly of the tubing string 278 as well as the drilling and/or well remediation operations. These operations may require physical labor on the part of the personnel as the personnel stand on the platform floor 272. Accordingly, the fan 250 of the assembly 201 is operated typically via user input at the regulated control assembly 224 (FIG. 17) to force a continuous stream of air 284 towards and then across the surface of the platform floor 272. The misting system 290 may be operated to dispense mist 294 from the misting nozzles 292 (FIG. 10) into the flowing air 284. Therefore, the personnel standing on the platform floor 272 are continuously cooled by the flowing air 284 and the mist 294 and can continuously carry out the drilling, remediation and/or other operations within the hydrocarbon well bore 280 for longer periods than would otherwise be feasible, particularly in hot weather. Moreover, the flowing air 284 blows mosquitoes and other insects away from the platform floor 272 and displaces hydrogen disulfide gas and/or other vapors from the platform floor 272. The operational speed of the fan 250 may be selected by controlling, the pressure regulating valve (not illustrated) through which the hydraulic or pneumatic working fluid flows to the fan motor 248, typically by manipulation of controls at the regulated control assembly 224.

While the illustrative embodiments of the disclosure have been described above, it will be recognized and understood that various modifications can be made in the disclosure and the appended claims are intended to cover all such modifications which may fall within the spirit and scope of the disclosure.

What is claimed is:

1. A method of cooling a platform floor on a rig platform of a workover-drilling rig, comprising:

providing an elevated platform cooling assembly having a portable assembly frame, a mast selectively positional between a folded and collapsed transport configuration and an erected and extended functional configuration on the assembly frame, a fan on the mast, a fan motor drivingly engaging the fan, a working fluid pump and supply mechanism disposed in fluid communication with the fan motor and a prime mover drivingly engaging the working fluid pump and supply mechanism;

deploying the mast in the transport configuration on the assembly frame;

transporting the elevated platform cooling assembly to the workover-drilling rig;

positioning the elevated platform cooling assembly adjacent to the platform floor on the rig platform;

raising the fan to a level of at least about 30 feet by erecting and extending the mast from the transport configuration to the functional configuration on the assembly frame; and forcing a stream of air from the fan across the platform floor on the rig platform of the workover-drilling rig by operation of the working fluid pump and supply mechanism.

2. The method of claim 1 wherein forcing a stream of air from the fan across the elevated platform by operation of the fan comprises concentrating and directing the stream of air across the platform floor on the rig platform of the workover-drilling rig by operation of the fan.

3. The method of claim 2 wherein concentrating and directing the stream of air across the platform floor on the rig platform of the workover-drilling rig comprises providing an air sock on the fan and forcing a stream of air from the air sock across the platform floor.

4. The method of claim 1 further comprising dispensing mist into the stream of air.

* * * * *